United States Patent [19]

Daghe et al.

[11] Patent Number: 4,489,746

[45] Date of Patent: Dec. 25, 1984

[54] BACKFLOW PREVENTER APPARATUS

[75] Inventors: Joseph L. Daghe, Decatur; Robert E. Sands, Shelbyville; Dennis W. Humes, Decatur, all of Ill.

[73] Assignee: Mueller Co., Decatur, Ill.

[21] Appl. No.: 383,305

[22] Filed: May 28, 1982

[51] Int. Cl.[3] ..... F16K 24/00

[52] U.S. Cl. ..... 137/218; 137/107

[58] Field of Search ..... 137/107, 218

[56] References Cited

U.S. PATENT DOCUMENTS

| | | |
|---|---|---|
| 1,703,248 | 2/1929 | Rothenbucher . |
| 1,960,144 | 5/1934 | Entriken . |
| 2,007,677 | 7/1935 | Farmer . |
| 2,329,368 | 9/1943 | Wood . |
| 2,389,413 | 11/1945 | Carlton . |
| 2,503,424 | 4/1950 | Snyder . |
| 2,577,967 | 12/1951 | Hughes . |
| 2,586,942 | 2/1952 | Grove . |
| 2,620,816 | 12/1952 | Griswold . |
| 2,646,816 | 7/1953 | Griswold . |
| 2,706,488 | 4/1955 | Harrington . |
| 3,181,560 | 5/1965 | Worden et al. . |
| 3,276,465 | 10/1966 | Wyckoff . |
| 3,724,487 | 4/1973 | Hunter . |
| 3,818,929 | 6/1974 | Braukmann . |
| 3,918,477 | 11/1975 | Grams ..... 137/218 |
| 4,099,527 | 5/1978 | Sutherland . |
| 4,132,246 | 1/1979 | Frisen . |
| 4,190,071 | 2/1980 | Dean et al. . |
| 4,231,387 | 11/1980 | Dixon . |
| 4,232,704 | 11/1980 | Becker et al. . |
| 4,241,752 | 12/1980 | Ackroyd . |
| 4,244,392 | 1/1981 | Griswold et al. . |
| 4,244,395 | 1/1981 | Griswold et al. . |
| 4,249,556 | 2/1981 | Waletzko . |
| 4,276,897 | 7/1981 | Griswold . |

OTHER PUBLICATIONS

Publication: "Handbook of Cross Connection Control", Edwin Reinecke, Copyrighted 1964 by Febco.

*Primary Examiner*—Gerald A. Michalsky

*Attorney, Agent, or Firm*—Cushman, Darby & Cushman

[57] ABSTRACT

A backflow preventer apparatus designed for connection between a supply pipe having liquid under pressure and a service pipe, the backflow preventer apparatus comprising a pair of check valves in series and defining a zone therebetween, a relief valve operable upon a change in differential pressure across the upstream check valve, and a vacuum breaker operable upon a drop in pressure in the zone to a predetermined pressure supply above atmospheric pressure. The differential pressure operable relief valve, when opened upon certain operating conditions, causing the zone to drain to atmosphere. The vacuum breaker operates independent of supply pipe pressure or service pipe pressure but solely on a drop in pressure in the zone.

11 Claims, 7 Drawing Figures

BACKFLOW PREVENTER APPARATUS

FIELD OF THE INVENTION

The present invention relates to a backflow preventer apparatus, and more particularly to such an apparatus utilizing two check valves in series defining a zone therebetween and having a relief valve operable upon a change in differential pressure across the upstream check valve, the relief valve being capable of draining the zone, and the apparatus further including a vacuum breaker in communication with the zone between the check valves, the vacuum breaker operating to permit the flow of air into the zone.

BACKGROUND OF THE INVENTION

Backflow preventer apparatus are well known in the art and are used in water distribution systems to prevent contamination of the potable water portion by preventing backflow of liquid from the non-potable portion beyond a certain point in the system. Two conditions tend to produce backflow in a water distribution system. The first condition which could cause backflow is known as "back siphonage" and this occurs in the potable supply pipe or main when its pressure drops to cause a vacuum or partial vacuum in that portion of the system. This will cause a backflow of liquid from the service pipe and if the liquid in the service pipe is contaminated, it will also contaminate the potable water supply. The second condition to cause backflow is a condition occurring in the service pipe or nonpotable portion of the system. This condition results in a back pressure condition when the pressure in the nonpotable service pipe exceeds that in the potable supply pipe.

The backflow preventer apparatus is usually installed with a gate valve on either side of the same in between a main or supply pipe for potable water and a service line which may be subjected to contaminants and thus be nonpotable water. Installations can be made at inlets to factories such as chemical plants and the like, or inlets to institutions, hotels or any large building complex.

In prior backflow preventer systems, vacuum breakers have been utilized upstream of the upstream check valve in a two check valve system or downstream of the downstream check valve in a two check valve system. When vacuum breakers were used upstream of the upstream check valve, they were provided primarily to take care of a backsiphonage condition where negative pressure occurred in the supply pipe. Such positioning of the vacuum breaker could be ineffective when the upstream of first check valve is fouled as the backsiphonage condition will permit water from the intermediate zone to pass through the first check valve with excessive check valve leakage. In the situation where the vacuum breaker was positioned downstream of the second or downstream check valve, its purpose was also to prevent backflow due to a backsiphonage condition. However, such positioning of the vacuum breaker required that it be higher than any portion of the service line. Otherwise, the pressure of fluid in the service line would maintain the vacuum breaker closed during the backsiphonage condition. Consequently, if the check valves were slightly fouled, backflow from the service line into the supply line would result.

Poppet-type check valves have been used in the past in backflow preventer apparatus, but they have not been entirely satisfactory because during a flow condition through the apparatus, there was too great a pressure loss especially at a high flow rate. The guides for the poppet-type check valve restricted the flow of liquid therethrough or caused turbulence. Additionally, the previous backflow preventer apparatus utilizing two poppet-type check valves had a large cavity between the seats of the check valves and, thus, caused loss during flow conditions rather than having a substantially straight through flow line.

SUMMARY OF THE INVENTION

According to the present invention, there is provided a backflow preventer apparatus which comprises a body member having a flow passage therethrough, the flow passage having an inlet for connection to a supply pipe and an outlet for connection to a service pipe. A first upstream check valve and a second downstream check valve are positioned in series in the flow passage and define therebetween a zone. When there is a demand for liquid in the service pipe, the first and second check valves are operable to open position to permit flow, but when there is no demand or when a backflow condition occurs, then the check valves are closed to prevent backflow. A differential pressure operable relief valve assembly is provided for draining the liquid in the zone to prevent a backflow condition because of back pressure or back siphonage. This relief valve senses the pressure differential across the first or upstream check valve and, thus, is in communication with pressure of liquid in the supply pipe as well as in communication with pressure of liquid in the zone. There is a predetermined pressure differential across said first check valve regardless of whether it is open or closed, and when this pressure differential drops a predetermined amount, the valve in the relief valve assembly opens and water from the zone is dumped to the exterior or atmosphere. A vacuum breaker communicates directly with the zone adjacent the highest point therein, the vacuum breaker having a valve element which is normally closed by the pressure of fluid in the zone. When the pressure of fluid in the zone drops to a predetermined amount slightly above atmospheric pressure, the vacuum breaker will open independently of the pressures of liquid in the supply pipe and the service pipe and air will enter the zone, and if the first or upstream check valve is fouled, it will flow through the same while liquid in the zone is being discharged to the exterior.

Another object of the present invention is to provide a backflow preventer apparatus having a poppet-type check valve therein which has a minimum loss of pressure when the check valve is in open position and a flow condition occurs. While there is a pressure drop across the poppet-type check valve regardless of whether the valve is open or closed, the configuration of the poppet-type check valve of this invention results in less pressure drop during flow conditions, especially at high flow conditions.

Another object of the present invention is to provide a backflow preventer apparatus with two check valves in series defining a zone therebetween. A vacuum breaker is in communication with the zone and, thus, does not have to be positioned higher than any point in the service line to operate during a back siphonage condition.

These and other objects and advantages of the present invention will appear more fully in the following specification and drawings.

DETAILED DESCRIPTION OF THE INVENTION

Figure 1:
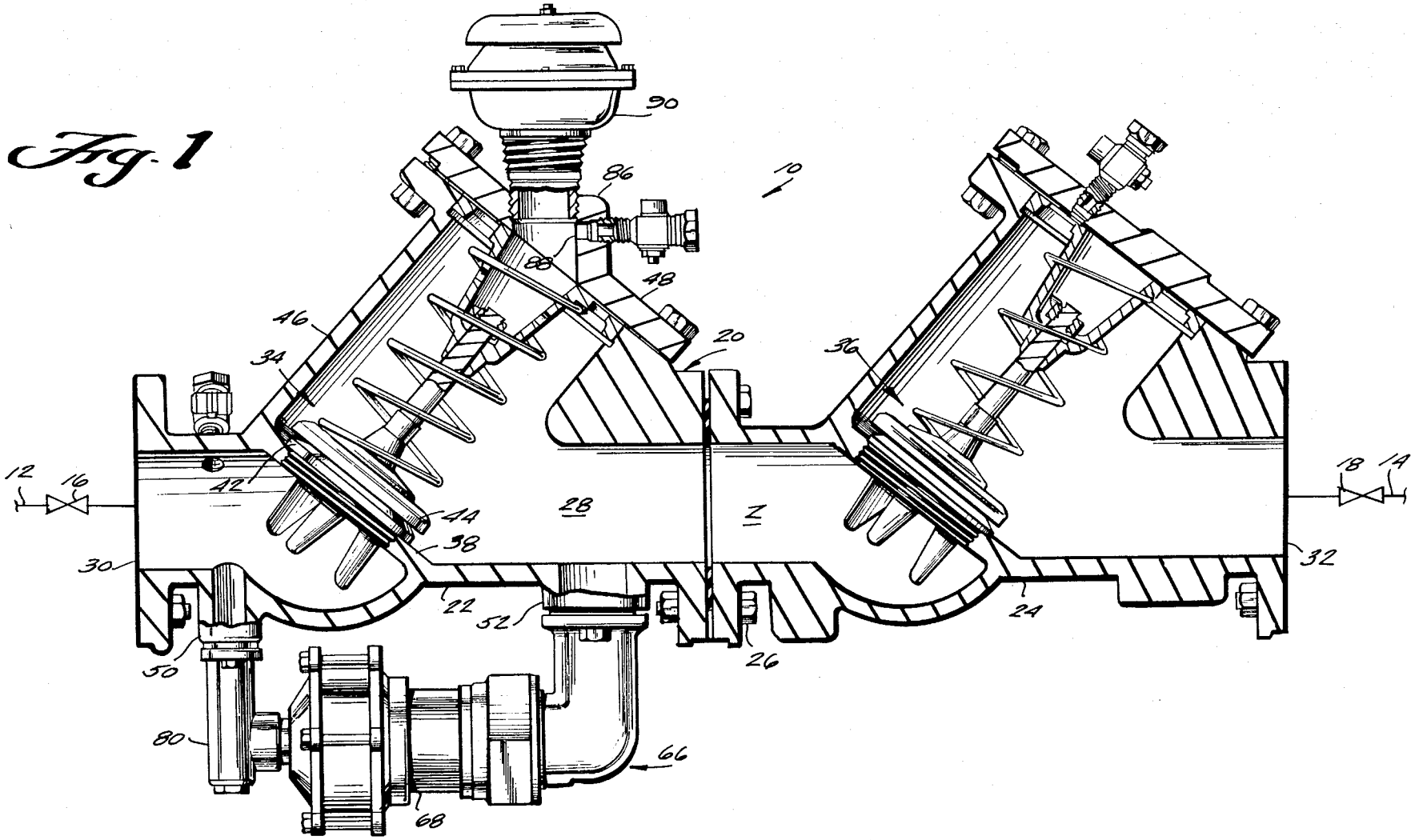
FIG. 1 is a partly schematic vertical sectional view of the backflow preventer apparatus of the present invention.

Referring to FIG. 1 wherein like characters or reference numerals represent like or similar parts, there is disclosed the backflow preventer apparatus of the present invention generally designated at 10. The backflow preventer apparatus 10 is positioned between a supply pipe 12 and a service pipe 14, the supply pipe being a main for potable water whereas the service pipe 14 is for nonpotable water, i.e., water which is or might be contaminated. Usually, the backflow preventer apparatus 10 is positioned between gate valves 16 and 18. The purpose of the gate valves, which are shown diagrammatically, is to test the system or to permit repair or replacement of the system.

The backflow preventer apparatus includes a body member 10 consisting of an upstream body portion 22 and a downstream body portion 24 bolted together as indicated at 26. Each body portion 22 and 24 carries a check valve, both check valves being open in the same direction to provide flow from the supply pipe 12 to the service pipe 14 when there is demand for liquid in the service pipe.

In more detail, the body member 20 is provided with a passageway 28 therethrough having an inlet 30 connected to gate valve 16 and an outlet 32 connected to gate valve 18. The upstream or first body portion 22 is similar in construction to the downstream or second body portion 24, and consequently a description of the body portion 22 and the first poppet-type check valve 34 will be given and will suffice for the description of the second or downstream body portion 24 and its poppet-type check valve 36. The portion of the passage 28 in body portion 22 is provided with a slanted web 38, FIG. 4, having a threaded aperture 40 therethrough for receiving a valve seat ring 42. The valve seat ring is tapered and has a diameter equal to the diameter of the passage 28.

The valve 34 which includes the valve seat ring 42 also includes the movable valve element 44 which is spring urged to the closed position on the valve seat ring. The movable valve element 44 is a preloaded module that is tamperproof and which is disclosed in more detail in U.S. application Ser. No. 383,307, now U.S. Pat. No. 4,453,561, filed concurrently herewith by Robert E. Sands and entitled "CHECK VALVE ASSEMBLY FOR USE IN BACKFLOW PREVENTERS OR THE LIKE."

The body portion 22 is provided with a boss or barrel member 46 having an axis coaxial with the axis of the valve seat ring, and a cover plate 48 is bolted thereto to retain the movable valve element 44 in position on the valve seat ring. The description thus far for the body portion 22 and its check valve 34 is the same as for the body portion 24 and its check valve 36. The only difference between the check valve 34 and the check valve 36 is the amount of spring loading for the respective modules. The spring loading for the upstream check valve is set at a higher value than that for the downstream check valve.

Figure 6:
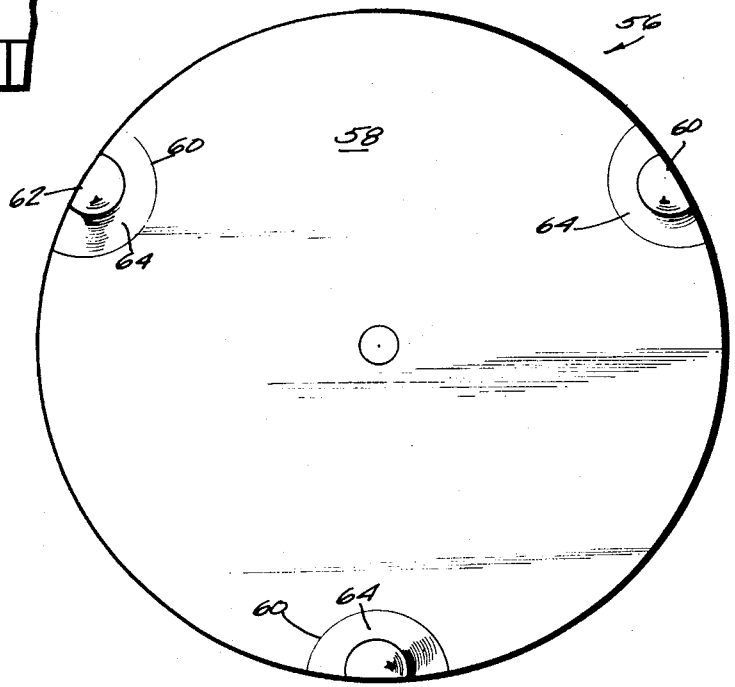
FIG. 6 is a view looking generally in the direction on arrow A in FIG. 5 and showing the disc shaped guide member and its plurality of guide fingers of the valve element.
Figure 4:
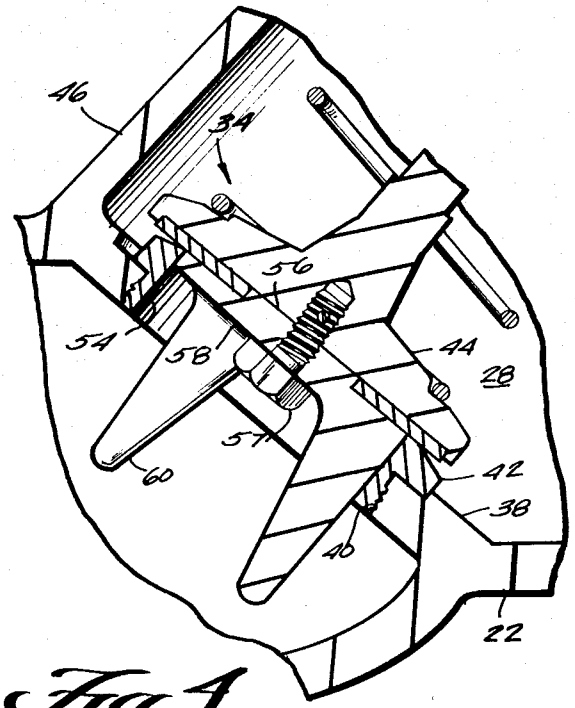
FIG. 4 is a fragmentary vertical sectional view of one of the poppet-type check valves of FIG. 1.
Figure 7:
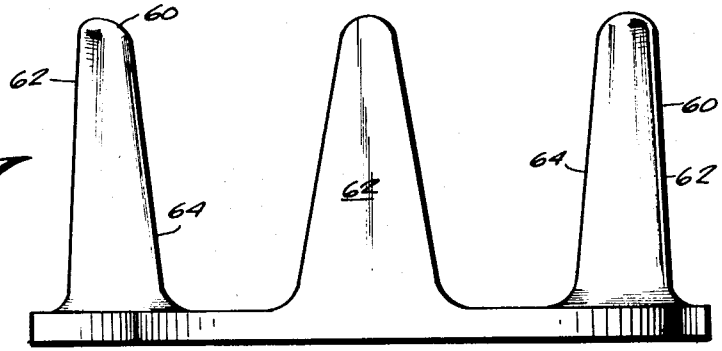
FIG. 7 is a side elevational view of FIG. 6, the view being taken when looking at FIG. 6 from the bottom of the sheet toward the top.

Each of the check valves 34 and 36 and the body member 20 is configured to provide a minimum loss of pressure when the check valves are open and under a flow condition. To accomplish this, the body member 20 has the passage 28 therethrough in a substantially straight line in that an annular wall 54 of the valve seat rings 42 has a diameter substantially equal to the diameter throughout the major portion of the passage 28. The movable valve element 44 for the check valves 34 and 36 is provided with a guide member 56 bolted thereto as indicated at 57 which includes a disc element 58 having a plurality of guide fingers 60 thereon. The disc 58 has a diameter which will permit it to fit within the annular wall 54 when the check valve is closed as shown in FIG. 4 and the fingers extend in an upstream direction. The shape of the fingers 60 is extremely critical to promoting smooth flow and reducing turbulence when the check valve is being opened. In this respect, each of the fingers 60 is tapered in an upstream direction from the disc 58, the taper being both circumferentially and radially along the axial length of the fingers. The exterior surface of the fingers which is shown in FIG. 6 at 62 is curved on the circumference of the disc 58 for engagement with the annular exterior wall 54 of the valve seat. It is also important to note that the interior surface 64 of each of the fingers has a rounded configuration extending from the edges of the circumferential surface 62.

Figure 5:
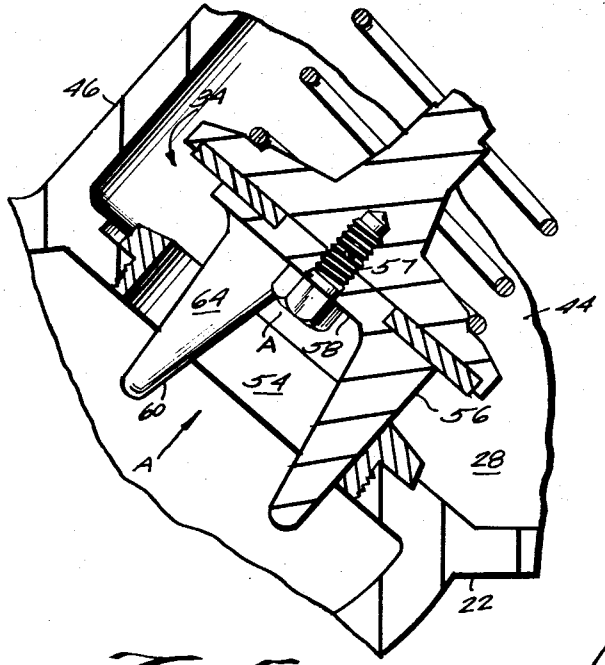
FIG. 5 is a view similar to FIG. 4 but illustrating the opening of the check valve.

As the check valve 34 or 36 begins to open, the area of the opening A (FIG. 5) between the fingers progressively increases for each unit of movement of the movable valve element 44. Additionally, as the movable valve element 44 of the valve 34 opens, the restriction caused by the guide fingers 60 to the flow through the valve decreases because of their taper and since the interior surface 64 is rounded, there is a minimum of turbulence to cause loss in pressure during flow conditions of the backflow preventer apparatus, even at high flow rates.

Figure 2:
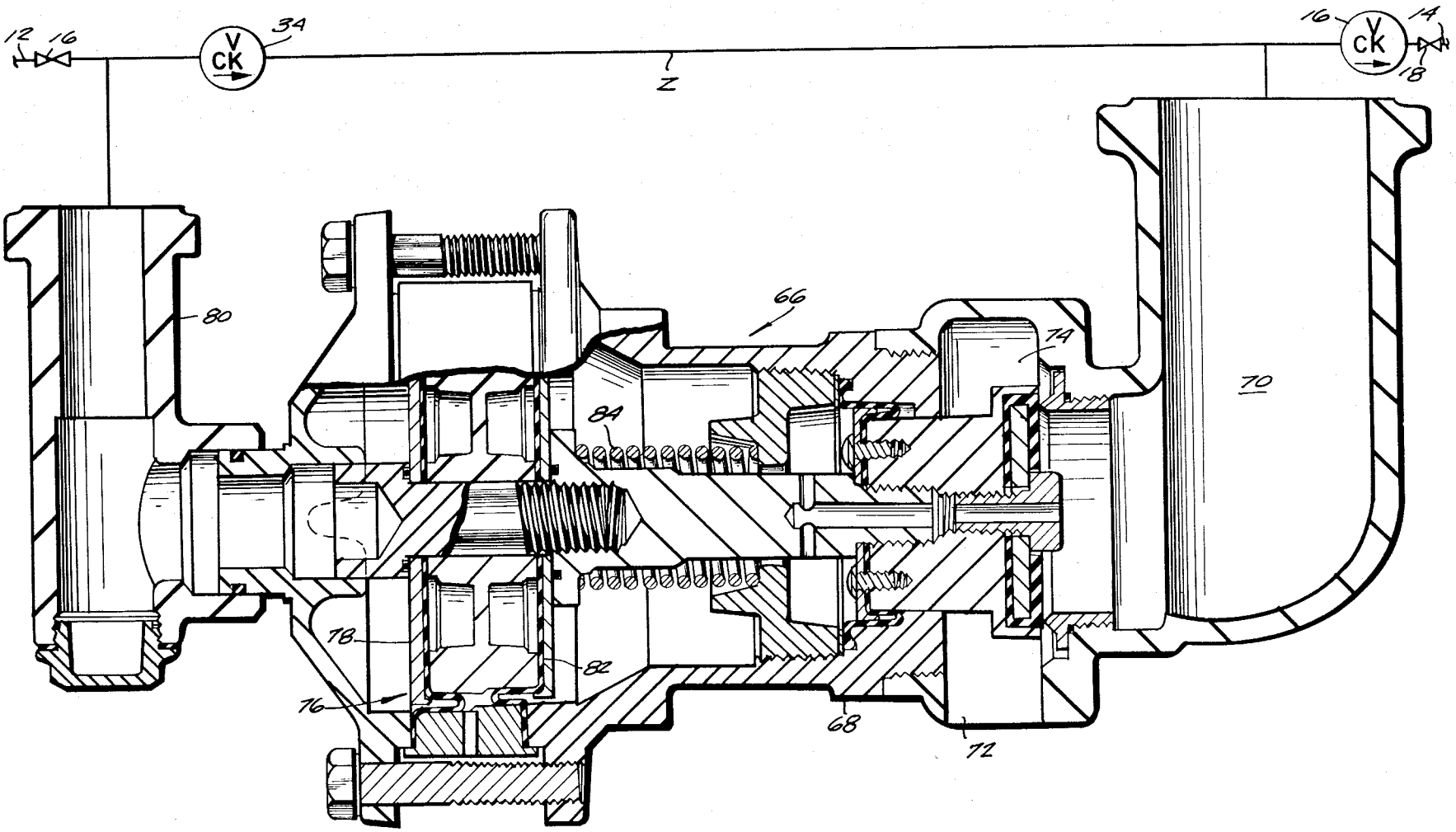
FIG. 2 is an enlarged vertical cross-sectional view of the relief valve assembly shown in FIG. 1.
Figure 3:
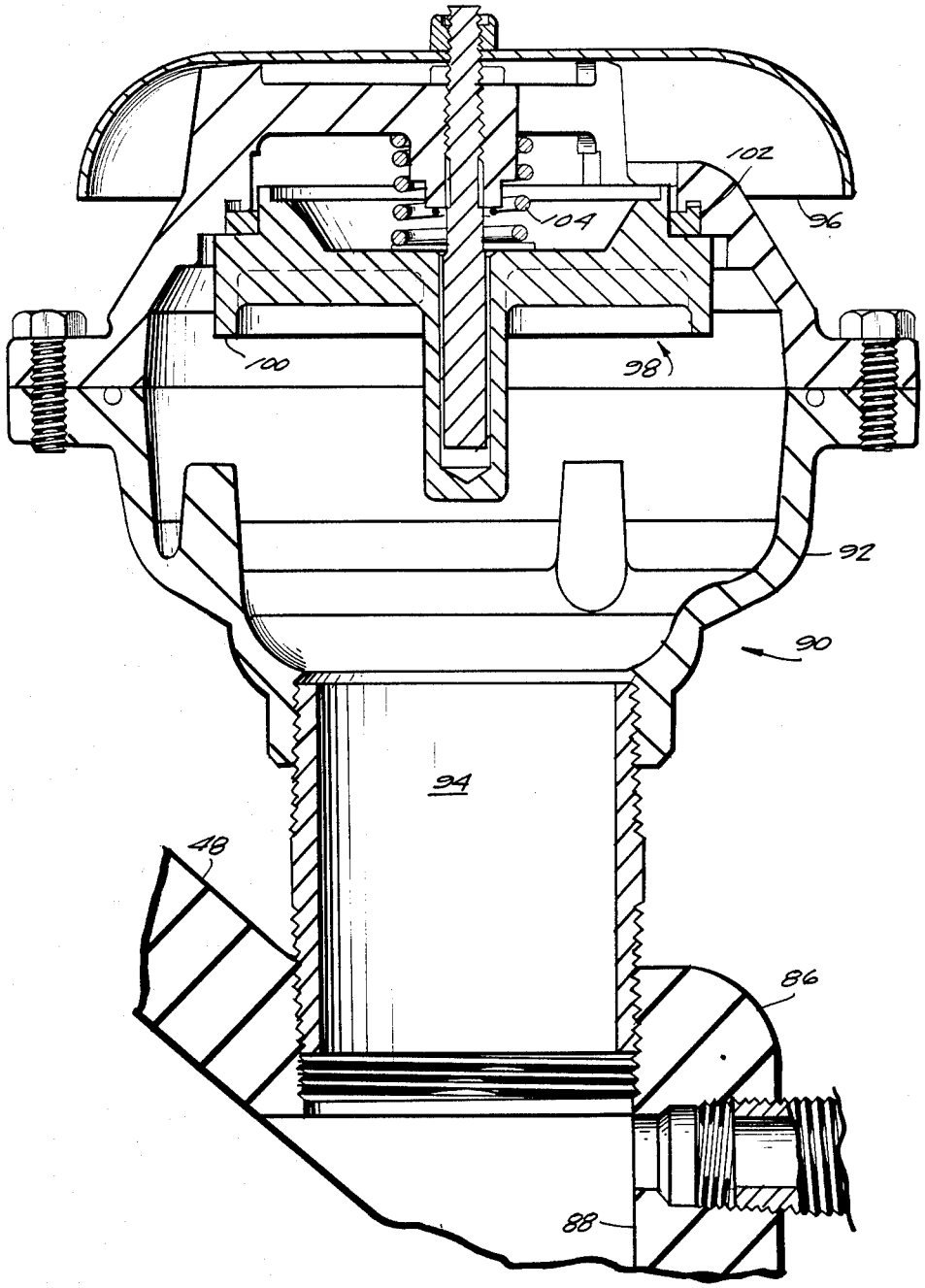
FIG. 3 is an enlarged vertical cross-sectional view of the vacuum breaker shown in FIG. 1.

The first or upstream body portion 22 of the body member 20 is provided on its lower side with a connection fitting 50 having communication with line pressure of the supply pipe 12 upstream of the first check valve 34. The body portion 22 is also provided with a second connection fitting 52 provided on the lower side of the upstream body portion 22 at a position downstream of the check valve 34. The second connection fitting 52 communicates with the zone Z between the two check valves 34 and 36. Attached to the fittings 50 and 52 is a differential pressure operable relief valve assembly 66. The relief valve assembly 66, which is best shown in FIG. 2, is disclosed in more detail in U.S. application Ser. No. 383,306, filed concurrently herewith by Joseph L. Daghe and Robert E. Sands, and entitled RELIEF VALVE ASSEMBLY FOR USE WITH BACKFLOW PREVENTERS. For the purpose of this application, a brief description of the relief valve assembly will follow.

The relief valve assembly is responsive to changes in differential pressure between the line pressure of the supply pipe 12 and the pressure of liquid in the zone Z between the check valves 34 and 36. The assembly 66 is provided with a housing 68 having a passage 70 therein which is in communication with the zone Z. The passage 70 has a downwardly facing outlet 72 and a normally closed valve 74 upstream of the outlet 72. The valve 74 is operatively connected to rolling diaphragm means 76, the rolling diaphragm means having one side 78 in communication through a connector 80 with line pressure of the supply pipe 12 and the other side 82 in communication with zone pressure through the valve means 74.

The differential pressure across the first check valve 34 is usually a predetermined amount, for example, 8 psi. Thus, the upstream or line pressure could be 60 psi during normal operation and the zone pressure could be 52 psi. When a backflow condition arises, which in the case of back siphonage causes a drop in line pressure, or in the case of back pressure where the pressure in the zone from the service line increases, there results a drop in differential pressure across the check valve 34. The rolling diaphragm means 76 coupled with the spring 84 is designed so that when the differential pressure drops from, for example, 8 psi, to, for example, 4 psi, the valve means 74 will open and permit liquid to drain from the zone.

The cover plate 48 for the check valve 34 is provided with a boss 86 having a partially threaded aperture 88 therethrough communicating with the zone Z at the highest point therein. A pressure-type vacuum breaker 90 is received in the threaded portion of the boss, and it includes a casing 92 having a passage 94 therethrough communicating with atmosphere at 96. A valve 98 including a downwardly movable valve element 100 and a downwardly facing valve seat 102 carried by the casing is normally urged to open position by a spring 104. Consequently, the pressure of fluid in the zone Z maintains the movable valve element 100 on its seat 102 during normal operation of the backflow preventer assembly 10. The spring 104 is calibrated so that when the pressure in the zone drops to a predetermined amount slightly above atmospheric pressure, the valve element 100 is urged off its seat by the spring so that air can flow into the zone. The spring pressure of spring 104 can be set so that the valve opens, for example, at about 2 psi above atmospheric pressure.

The vacuum breaker 90 by being located between the check valves 34 and 36 functions regardless of pressure changes in the supply line or the service line. In other words, when the relief valve assembly 66 is dumping liquid from the zone Z and the pressure in the zone drops to the predetermined amount slightly above atmospheric. The valve 98 opens and air can enter the zone and increase the discharge of liquid therefrom or permit the air to flow through a fouled first check valve 34 when a back siphonage condition occurs. By having the vacuum breaker upstream of the downstream check valve 36, it is not influenced by pressure in the service line and, thus, does not have to be positioned above the highest point in the service line.

The terminology used throughout the specification is for the purpose of description and not limitation, the invention being defined by the scope of the claims.

What is claimed is:

1. A backflow preventer apparatus having an inlet adapted to be connected to a supply pipe having liquid under pressure therein and an outlet adapted to be connected to a service pipe, said backflow preventer apparatus comprising:

a body member having a flow passage therethrough;

a first check valve and a second check valve in series in said passage and defining therebetween a zone, said first check valve and said second check valve being operable to open position to permit flow of liquid from said supply pipe to said service pipe when there is a demand for liquid in said service pipe;

a differential pressure operable relief valve assembly communicating respectively with pressure of liquid in said supply pipe and in said zone between said first and second check valves, said relief valve assembly having a passage from said zone terminating in an outlet to atmosphere and having a valve therein operable to open position upon a predetermined drop in differential pressure between said supply pipe pressure and said zone pressure caused by backsiphonage in said supply pipe or by backpressure in said service pipe whereby liquid in said zone discharges to atmosphere through the outlet of said relief valve assembly; and a vacuum breaker means communicating directly with said zone between said first and second check valves adjacent the highest point therein, said vacuum breaker means having a valve element therein normally closed by pressure of fluid in said zone when pressure of fluid in said zone is greater than a predetermined pressure slightly above atmospheric pressure, and said valve element in said vacuum breaker means being opened completely independently of pressures of liquid in said supply pipe and said service pipe and only when pressure of fluid in said zone drops to said predetermined pressure slightly above atmospheric pressure.

2. A backflow preventer as claimed in claim 1 in which said vacuum breaker means includes a downwardly facing valve seat for said valve element and spring means normally urging said valve element off of said valve seat, said spring means coupled with atmospheric pressure providing the predetermined pressure slightly above atmospheric pressure at which said valve element opens when pressure of fluid in said zone drops thereto.

3. A backflow preventer apparatus as claimed in claim 1 in which said body member includes a pair of generally cylindrical bosses for housing said first and second check valves respectively and in which said body member further has a valve seat for each of said check valves lying in a plane at an acute angle to the longitudinal axes of said passage and normal to the respective longitudinal axes of said bosses, each of said check valves being spring urged to the closed position on its respective seat.

4. A backflow preventer apparatus as claimed in claim 3 in which each of said check valves is a spring loaded module and in which each of said bosses include a coverplate for holding said check valves in said respective bosses.

5. A backflow preventer apparatus as claimed in claim 4 in which said first check valve is up-steam of said second check valve and the coverplate for the boss housing the first check valve also carries said vacuum breaker means.

6. A backflow preventer apparatus as claimed anyone of claims 3 to 5 in which said flow passage through said body member has a cross-sectional area, except for where said bosses are, equal to the cross-sectional area of said supply pipe and said service pipe and wherein the cross-sectional area of said valve seats equals the cross-sectional area of said flow passage.

7. A backflow preventer apparatus as claimed in claim 6 wherein each of said check valves includes a disc shaped guide member, said disc shaped guide member having a plurality of guide fingers extending therefrom through said valve seat and engaging the wall thereof, each of said guide fingers tapering in an upstream direction both circumferentially and radially and having interior rounded surfaces for reducing pressure loss during a flow condition.

8. A backflow preventer apparatus as claimed in any one of claims 3 to 5 in which said bosses extend upwardly and outwardly from said body member, and in which said relief valve assembly is positioned below said body member, said relief valve assembly including a poppet-type valve element operable on a horizontal axis, said poppet-type valve element being spring urged toward open position and being maintained in closed position by a predetermined differential pressure across said first check valve.

9. A backflow preventer apparatus as claimed in claim 8 wherein communication of said relief valve assembly with pressure of liquid in said supply pipe is through the lower portion of said body member immediately upstream of said first check valve and wherein communication of said relief valve assembly with pressure of liquid in said zone is immediately downstream of said first check valve in the lower portion of said body member.

10. A backflow preventer apparatus as claimed in claim 9 wherein said body member includes an upstream body portion and a downstream body portion bolted together, said upstream body portion including said first check valve, said vacuum breaker means, and said relief valve assembly, and said downstream body portion including said second check valve.

11. A backflow preventer apparatus as claimed in any one of claims 1 to 5 in which a pressure differential across said first check valve during normal operation is in the order of 8 psi and in which said relief valve assembly operates to open position to drain liquid from said zone when said pressure differential across said first check valve drops in the order of 4 psi, and in which said vacuum breaker means operates to open position when said zone pressure drops to about 2 psi above atmospheric pressure.

* * * * *